United States Patent [19]

Cavedo

[11] Patent Number: 4,693,648

[45] Date of Patent: Sep. 15, 1987

[54] DEPTH OF CUT ADJUSTING MECHANISM

[75] Inventor: Robert P. Cavedo, Easley, S.C.

[73] Assignee: The Singer Company, Stamford, Conn.

[21] Appl. No.: 876,042

[22] Filed: Jun. 19, 1986

[51] Int. Cl.[4] ..... B27C 1/10

[52] U.S. Cl. ..... 409/178; 144/117 C; 30/475

[58] Field of Search ..... 409/181, 182, 178, 175; 144/117 C, 136 R; 30/475, 477; 408/98

[56] References Cited

U.S. PATENT DOCUMENTS 4,335,768 6/1982 Bachmann ..... 30/475
4,360,048 11/1982 Schadlich et al. ..... 144/117 C X
4,382,729 5/1983 Bachmann ..... 409/178

*Primary Examiner*—Z. R. Bilinsky
*Attorney, Agent, or Firm*—David L. Davis

[57] ABSTRACT

A depth of cut adjusting mechanism for a planer comprising an infeed shoe which is spring biased upwardly from the plane in which the planer cutter operates against a stop provided by a spiral cam formed on the infeed shoe and abutting a cam follower adjustably supported on the planer.

3 Claims, 6 Drawing Figures

Fig. 1.
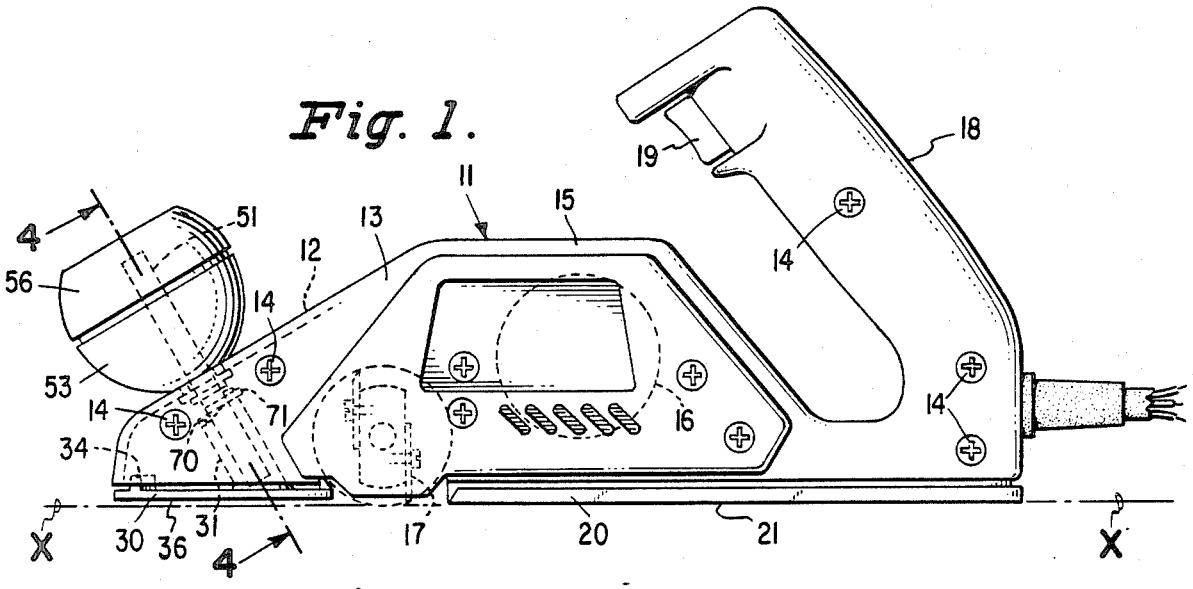
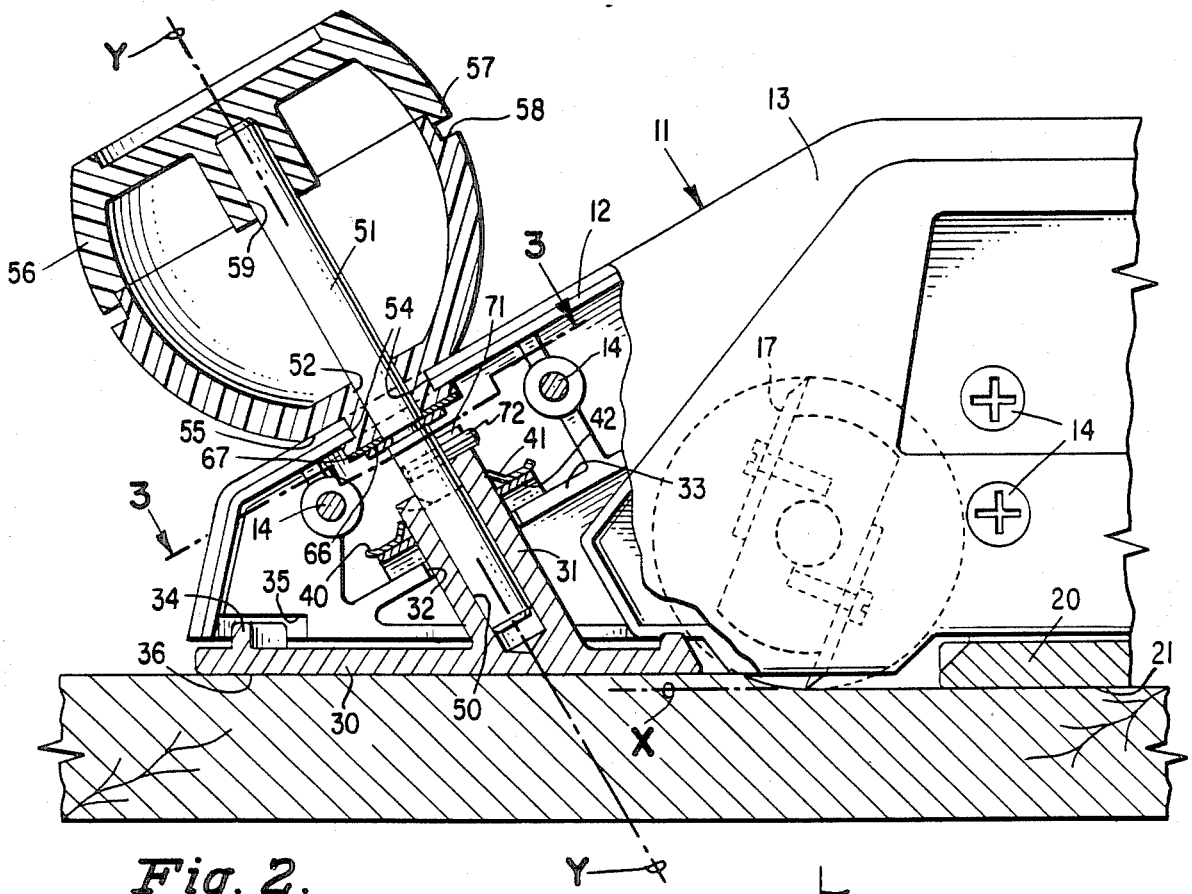
Fig. 2.
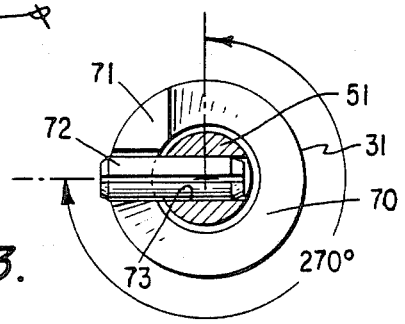
Fig. 3.

DEPTH OF CUT ADJUSTING MECHANISM

BACKGROUND OF THE INVENTION

1. Field of the Invention

This invention relates to power tools such as power planers and, more particularly, to a new and improved depth of cut adjusting mechanism for power tools.

2. Description of the Art

The U.S. Pat. No. 4,335,768, June 22, 1982 is representative of the prior art depth of cut adjusting mechanisms in its disclosure of a work infeed shoe arranged forwardly of a power tool cutter and vertically adjustable by means of a threaded adjustment element working against spring means biasing the shoe downwardly toward the work.

3. Objects of the Invention

It is an object of this invention to provide a cost effective depth of cut adjusting mechanism for a power tool such as a planer utilizing half the parts of prior known devices of this nature, with the parts characterized by low tolerance requirements, simplicity of manufacture, and ease of assembly. It is a further object of this invention to provide a mechanism of the above description in which the depth of cut controlled thereby is not influenced by varying or excessive downward force applied to the power tool by the tool operator.

SUMMARY OF THE INVENTION

The above and additional objects and advantages of this invention are attained by the provision of interengaging spiral cam and follower means arranged between a vertically shiftable work infeed shoe and an adjusting handle journaled on the power tool frame, with spring means biasing the work infeed shoe upwardly against the control stop provided by engagement of the spiral cam and follower means.

DESCRIPTION OF THE DRAWINGS

With the above and additional objects and advantages in view as will hereinafter appear, this invention will be described with reference to a preferred embodiment illustrated in the accompanying drawings in which:

FIG. 1 is a side elevational view of a power planer having the depth of cut adjusting mechanism of this invention applied thereto;

FIG. 2 is an enlarged side elevational view of the front portion of the planer frame broken away to expose the depth of cut adjusting mechanism which is illustrated in vertical cross section;

FIG. 3 is a cross sectional view showing the depth of cut adjusting cam and cam follower and taken substantially along line 3—3 of FIG. 2;

DESCRIPTION OF THE PREFERRED EMBODIMENT

Figure 4:
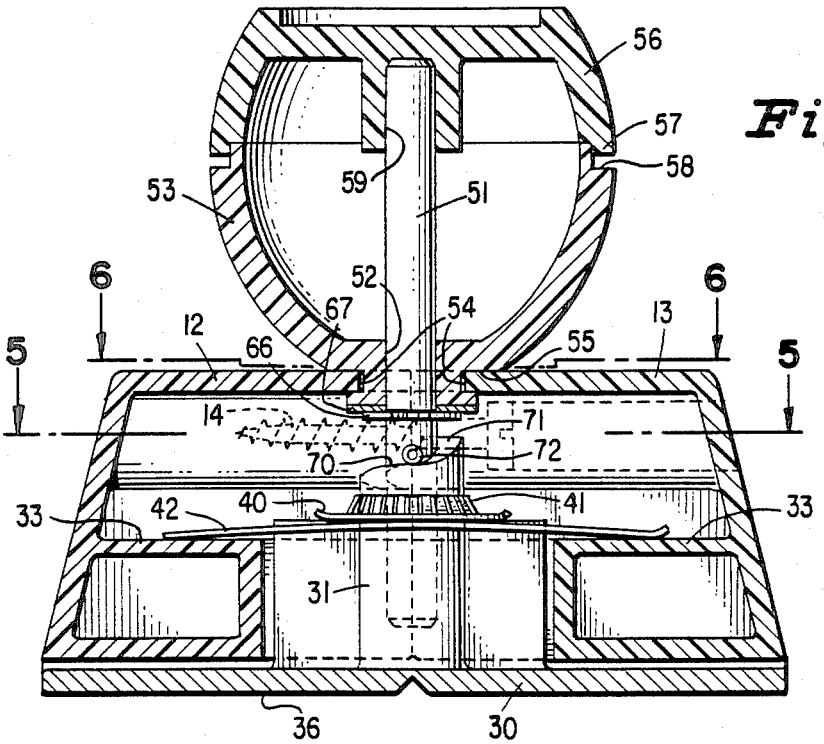
FIG. 4 is a cross sectional view taken substantially along line 4—4 of FIG. 1.
Figure 5:
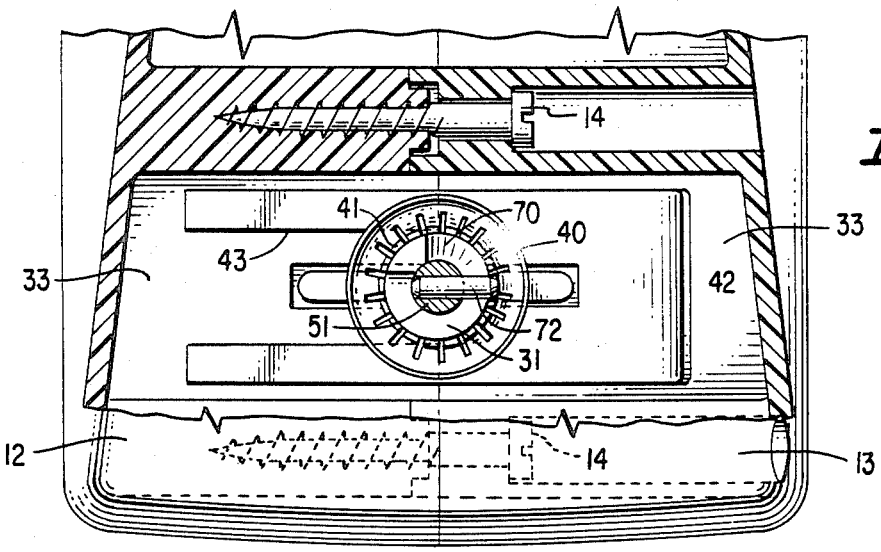
FIG. 5 is a cross sectional view taken substantially along line 5—5 of FIG. 4.
Figure 6:
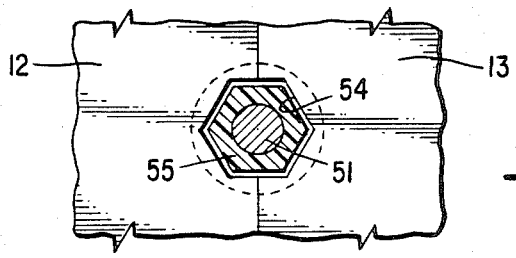
FIG. 6 is a cross sectional view taken substantially along line 6—6 of FIG. 4.

Indicated generally at 11 in FIGS. 1 and 2 is a power planer to which the depth of cut adjusting mechanism of this invention is applied. The planer includes a frame which may be split into halves 12 and 13 clamshell fashion, substantially along the longitudinal centerline of the planer, or otherwise formed in sections secured together by fastening screws 14. The frame is formed with a body portion 15 housing a motor 16 and a transversely arranged cutter 17 driven by the motor. The frame may also be formed with a handle 18 including a motor controlling switch 19. Fitted rearwardly of the cutter 17 beneath the planer frame 11 is a work engaging platen 20 of which the flat underside 21 defines a plane X—X. The cutting edges of the cutter 17 are adjusted to move in paths tangent to the plane X—X.

Mounted in the planer frame forwardly of the cutter 17 is an infeed shoe 30. The infeed shoe includes a cylindrical stem 31 slidably accommodated in a bearing aperture 32 preferably formed in a frame web 33 which may constitute portions of each of the frame halves 12 and 13 so as to guide the infeed shoe 30 for movement along the inclined path Y—Y. A projection 34 extending upwardly from the infeed shoe 30 is accommodated in a guide slot 35 in the planer frame to constrain the infeed shoe to translatory movement with respect to the planer frame and maintain the undersurface 36 of the infeed shoe parallel to the plane X—X defined by the platen underside 21 which is the plane in which the cutter 17 operates upon a workpiece.

A retaining ring 40 is secured on the upper extremity of the stem 31 of the infeed shoe 30 at a position above the frame web 33 in the assembled position of the parts. The retaining ring 40 may be formed with a plurality of inwardly extending and upwardly inclined grip fingers 41 which, when forced downwardly over the stem 31, bite into the stem and prevent upward movement of the retaining ring relative to the stem. Between the retaining ring 41 and the frame web 33 an upwardly arched spring strip 42 is constrained so as to apply a force biasing the infeed shoe upwardly along the path Y—Y. The arched spring strip 42 may be slotted as at 43 so as to be insertable between the retaining ring 43 and the frame web 33 during assembly of the infeed shoe into the frame halves 12 and 13.

The infeed shoe stem 31 is formed with a plain axial bore 50 within which an adjusting stud 51 is freely rotatable and slidable. The adjusting stud 51 passes through a bore 52 formed in a knob base 53 which is located and locked against movement relatively to the planer frame by a noncircular aperture 54 formed between the frame halves 12 and 13 which accommodates a correspondingly noncircular recess 55 formed in the knob base 53.

An outer knob portion 56 which is journaled by means of an annular flange 57 engaging an annular groove 58 in the knob base 53 is formed with a socket 59 into which the knurled extremity of the adjusting stud 51 is forced tightly to secure the stud 51 to the knob portion 56. Any other fastening means such as a screw or the like might also be used to secure the stud 51 to the knob 56.

A retaining washer 66 is seated in an annular groove in the adjusting stud 51 beneath the knob base 53 and may be separated from the knob base by an antifriction washer 67 so that the knob base 53 provides a stop limiting upward movement of the stud 51.

The free upper extremity of the infeed shoe stem 31 is formed with a spiral cam surface 70 terminating at each end in an upstanding abutment projection 71. A transverse follower pin 72 is carried by the adjusting stud 51 and projects laterally therefrom in tracking engagement with the spiral cam surface 70. The follower pin 72 may preferably take the form of a spring pin force fit in a transverse aperture 73 through the adjusting stud.

As shown in FIGS. 2 and 4, the follower pin 72 controls the upper limit of the infeed shoe position urged by the spring 42, which position may be adjusted by turning the outer knob portion 56.

As shown in FIG. 3, the projection 71 limits rotation of the follower pin 72 and hence of the knob portion 56 to approximately 270°. Depending upon the slope of the spiral cam, this rotational movement of the follower pin 72 influences the travel of the infeed shoe with respect to the plane of the cutter 17 and platen 20. Preferably, the follower pin and spiral cam are arranged to influence a range of positions of the infeed shoe undersurface 36 from coincidence with the plane X-X of the underside of the platen 20 to an elevated position 90 to 100 thousandths of an inch above the plane X—X. It will be appreciated that a work piece positioned flush against the infeed shoe undersurface toward which the cutter 17 is moved relatively will be cut by the cutter 17 to a depth equal to the elevation of the infeed shoe undersurface above the plane of X—X in which the cutter 17 cuts.

The arrangement of the spiral cam and follower pin may be reversed with the cam being carried by the adjusting stud and the follower carried by or formed on the infeed shoe stem.

Since the spring 42 biases the infeed shoe upwardly against the stop provided by the follower pin on the adjusting stud, downward pressure applied by a tool operator does not influence the depth of cut adjustment, and therefore, with the present invention such operator influenced downward pressure, which may be conducive to a smooth chatter-free cut by the planer, does not adversely affect the depth of cut.

An additional advantage of the construction of this depth of cut adjusting mechanism of this invention is the cost effectiveness which is provided not only by the simplicity of the parts, but also by the facility of assembly which this construction makes possible. As shown in FIG. 2, the entire depth of cut adjusting mechanism of this invention can be assembled and positioned in place in one planer frame half 12 which the other frame half 13 removed from the planer. Then, as shown in FIG. 4, the frame half 13 can be moved into place while the right hand extremity of the arched spring 42 is temporarily raised to clear the frame web 33 on the frame half 13. When the frame halves are in abutting relation and secured togehter by screws 14, the spring 42 can be released to bear against webs 33 and to bias the infeed shoe upwardly against the follower pin 72 by contact under the retaining ring 40 on the stem 31.

Having set forth the nature of this invention, what is claimed herein is:

1. In a power planer having a frame including a platen having an underside defining a plane of support for said planer, a cutter supported adjacent said platen and arranged to cut in the plane defined by the underside of said platen, and a depth of cut adjusting mechanism comprising;

an infeed shoe having a planar undersurface arranged at the opposite side of said cutter from said platen;

means shiftably supporting said infeed shoe on said planer frame in said undersurface parallel to the plane defined by said platen;

spring means arranged between said planer frame and said infeed shoe biasing the undersurface of said infeed shoe upwardly toward a position above the plane defined by said platen underside;

an operator influenced knob constrained on said planer frame; and abutment means limiting the spring biased position of said infeed shoe and including an interengaging cam and cam follower means associated one with said infeed shoe and the other with said operator influenced knob;

said operator influenced knob being constrained on said planer frame by a bearing supporting said knob for rotation about an axis inclined with respect to the plane defined by said platen underside and preventing axial movement of said knob; said infeed shoe being formed with a bore; a stud slidably accommodated in said bore and secured coaxially on said knob; said cam means comprising a spiral cam surface formed on said infeed shoe surrounding said bore; and said cam follower comprising a pin projecting laterally from said stud.

2. A depth of cut adjusting mechanism as set forth in claim 1 in which said spiral cam surface on said infeed shoe is interrupted by a projection extending parallel to said bore defining a stop means limiting turning movement of said knob and cam follower pin to less than one rotation.

3. In a power planer having a frame comprising frame halves abutting along the lengthwise centerline of the planer, a platen carried by said frame defining a plane of support for said planer, a motor in said frame, a cutter driven by said motor and supported at one side of said platen in said frame to cut in said plane of support defined by said platen, and a depth of cut adjusting mechanism carried by said planer frame at the opposite side of said cutter from said platen, said depth of cut adjusting mechanism comprising:

an infeed shoe having a planar undersurface, a cylindrical stem formed on said infeed shoe;

bearing means formed conjointly between the planer frame halves for slidably accommodating said cylindrical stem to position the undersurface of said infeed shoe parallel to the plane of support defined by said platen, an operator influenced adjusting knob, a stud fixed to said knob for turning movement therewith, supporting means formed conjointly between said planer frame halves for constraining said knob and stud axially while permitting turning movement thereof;

cooperating cam and cam follower means carried on said knob stud and on said infeed shoe stem providing an adjustable stop limiting the position of said infeed shoe undersurface above the plane of support defined by said platen, and an arched leaf spring acting between said frame halves and said infeed shoe stem biasing said cam and cam follower into cooperative relation, said depth of cut adjusting mechanism being accommodated fully assembled in the bearing means and support means of a selected either one of the planer frame halves;

said selected one of said planer frame halves operatively supporting only one extremity of said arched leaf spring;

assembly thereof of the other of said planer frame halves constraining said depth of cut mechanism in said conjoint bearing and support means and operatively supporting the opposite extremity of said arched leaf spring.

* * * * *